US006488396B1

(12) United States Patent
Hayakawa et al.

(10) Patent No.: US 6,488,396 B1
(45) Date of Patent: Dec. 3, 2002

(54) VEHICLE HEADLAMP

(75) Inventors: Michihiko Hayakawa, Shizuoka (JP); Mitsuyuki Mochizuki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 15 days.

(21) Appl. No.: 09/691,718

(22) Filed: Oct. 18, 2000

(30) Foreign Application Priority Data

Oct. 19, 1999 (JP) ..... 11-296080

(51) Int. Cl.[7] ..... F21W 101/10

(52) U.S. Cl. ..... 362/539; 362/513; 362/510; 362/282; 362/324

(58) Field of Search ..... 362/512, 513, 362/538, 539, 282, 277, 322, 324, 510

(56) References Cited

U.S. PATENT DOCUMENTS 5,213,406 A 5/1993 Nemann et al. ..... 362/61
5,488,546 A * 1/1996 Sato et al. ..... 362/61
5,879,073 A * 3/1999 Hori et al. ..... 362/539 X
6,012,830 A * 1/2000 Fraizer ..... 362/539
6,132,068 A * 10/2000 Katsumata ..... 362/539 X

FOREIGN PATENT DOCUMENTS

GB 2332742 A 6/1999 ..... B60Q/1/076
GB 2341672 A 3/2000 ..... B60Q/1/14
GB 2341673 A 3/2000 ..... B60Q/1/14

* cited by examiner

*Primary Examiner*—Laura K. Tso
(74) *Attorney, Agent, or Firm*—Fish & Richardson P.C.

(57) ABSTRACT

A movable shade 22 capable of shading part of light incident on a reflector 20 from a discharge bulb 18 is pivoted longitudinally by a shade driving unit 24 to switch beams. A shade body portion 22A surrounding the discharge bulb 18 is colored blue. Thus, the blue color of the shade body portion 22A appears to be reflected on the reflector 20 when a lamp is viewed from the front while the movable shade 22 stays in a low-beam position. When a reflective area C reflecting the blue color varies in shape and size as the movable shade 22 moves to a high-beam position, beam switching can be visually confirmed easily.

13 Claims, 5 Drawing Sheets

VEHICLE HEADLAMP

FIELD OF THE INVENTION

The present invention relates to a vehicle headlamp arranged to vary light distribution of the lamp by moving a movable shade.

BACKGROUND OF THE INVENTION

Vehicle headlamps are arranged to emit low or high beams by causing reflectors to reflect light from light sources forward. However, because the light distribution patterns differ between low and high beams, it is common to use a light source bulb having two light sources or two light source bulbs for the purpose of switching between the low and high beams.

A vehicle headlamp using a single light source for switching beams, particularly, a two-lamp type headlamp using a discharge bulb as a light source bulb is known.

One method for switching beams using a single light source switches beams by moving a movable shade. In this method, the movable shade is made movable by a shade driving unit between two positions each providing a different degree of shading of the incident light from the light source.

The movable shade is arranged so that its shade body portion is formed to surround the light source. When the lamp is viewed from the front of the lamp, the outer surface of the shade body portion used to shade the light from the light source radiating on the reflector appears on the reflector. Moreover, the portion reflected on the reflector varies with the movement of the movable shade when the beam is switched.

Since the surface color of the shade body portion of the movable shade in the conventional vehicle headlamp is colorless, for example, black, gray or silver that is the same as that on the reflective surface of the reflector, a portion where the outer surface of the shade body portion is reflected remains almost inconspicuous when viewed from the front of the lamp. For this reason, even though the beams are switched, it is difficult to visually confirm the variation of the reflection of the outer surface of the shade body portion, so that the appeal of the lamp may be diminished.

The problem of this type generally arises from not only switching beams between low and high by moving such a movable shade but also switching beams by moving the movable shade.

An object of the present invention is to provide a vehicle headlamp that is designed to facilitate the confirmation of changes in the light distribution of the headlamp from the front thereof when its movable shade is moved.

SUMMARY OF THE INVENTION

The present invention is intended to accomplish the object above by providing the shade body portion of a movable shade with a unique color.

A vehicle headlamp according to an embodiment of the invention comprises a light source, a reflector for reflecting light from the light source forward, a movable shade capable of shading part of the light incident on the reflector from the light source, and a shade driving unit for moving the movable shade between at least two positions where the incident light is shaded in different degrees. A shade body portion surrounding the light source in the movable shade has an outer surface having a chromatic color.

The above "light source" is not limited to a specific kind but maybe any discharge light emitting bulb portion, for example, an incandescent bulb such as a halogen bulb.

The "movable shade" may be of any kind capable of shading part of light incident on the reflector from the light source bulb and not limited to a specific configuration.

The above "at least two positions" where the incident light shading quantity has different values may be only two positions or may be more than two positions and moreover may include or may not include a position where a low- or high-beam light distribution pattern is formed when the movable shade is located in that position.

The "shade driving unit" is not limited to a specific driving unit but may be any one so designed as to move the movable shade between at least two positions. For example, the shade driving unit may comprise a solenoid, a pulse motor or the like. Further, the "moving behavior" of the movable shade by use of the shade driving unit is not restrictive but may be pivotal, linearly reciprocal or the like.

The above "shade body portion" may have its outer surface colored or may be made of a material of chromatic color or may otherwise have the outer surface treated with a chromatic color. The "chromatic color" according to the invention not only includes a chromatic color on colorimetry such as a yellow or blue but also a metal color for providing chromatic color luster.

The vehicle headlamp according to an embodiment of the invention is equipped with the shade driving unit for moving the movable shade, capable of shading part of light incident on the reflector from the light source, between two positions where the incident light is shaded differently. If the outer surface of the shade body portion surrounding the light source in the movable shade is chromatically colored, the following effect can be achieved.

When the lamp is viewed from the front, the reflective surface of the reflector is generally seen to have the surface color of the shade body portion (achromatic color such as black or gray, or other colors such as silver) or a transparent color of the glass tube of the light source, the silver color of the inner wall surface of the reflector or the like. In the case of the vehicle headlamp according to an embodiment of the invention, however, the chromatic color on the outer surface of the shade body portion is also seen to be incorporated in the reflective surface of the reflector depending on the position of the movable shade. This portion incorporating the chromatic color appears to be very conspicuous because the remaining portion of the reflective surface only bears the silver or achromatic color. In other words, this portion incorporating the chromatic color on the reflective surface of the reflector varies in shape and size as the movable shade moves. Therefore, changes in the light distribution of the lamp can be visually confirmed readily from the front thereof when the movable shade moves.

In the vehicle headlamp arranged to change the light distribution of the lamp by moving the movable shade according to the invention, changes in the light distribution of the lamp can be visually confirmed easily from the front of the lamp by moving the movable shade. Also, the design of the headlamp can be improved.

With the arrangement above, the shade driving unit is set so that the movable shade becomes stationary in a position where the chromatic color of the outer surface of the shade body portion is reflected on the reflector while the lamp is turned off. Part of the reflector appears to have the chromatic color when the lamp is viewed from the front of the lamp while the lamp is turned off. Thus, the design of the lamp can also be improved.

With the arrangement above, the movement of the movable shade by the shade driving unit is made in a manner that displaces the shade body portion substantially longitudinally, so that the area of the chromatic color portion reflected on the reflector greatly varies with the movement of the movable shade. Consequently, changes in the light distribution of the lamp can be visually confirmed easily from the front of the lamp by moving the movable shade. Thus, the design of the lamp can be improved further.

With the arrangement above, the fixed shade for covering the movable shade substantially in front of the movable shade makes it difficult for the movable shade and its peripheral structure to be seen from the outside. When the outer surface of the shade body portion has the chromatic color, the light reflected from the reflector is reflected from the outer surface thereof so as to easily generate stray light in comparison to where the chromatic color is black. However, the fixed shade results in effectively preventing the generation of such stray lights. In this case, the color of the outer surface of the fixed shade is not limited to a specific color. Any achromatic color can be used such as black or gray for use as a surface color of an ordinary shade, silver, the same color as the color of the vehicle body, the same chromatic color as that of the outer surface of the shade body portion, or any complementary color.

DETAILED DESCRIPTION OF THE INVENTION

An embodiment of the present invention will now be described with reference to the drawings.

Figure 1:
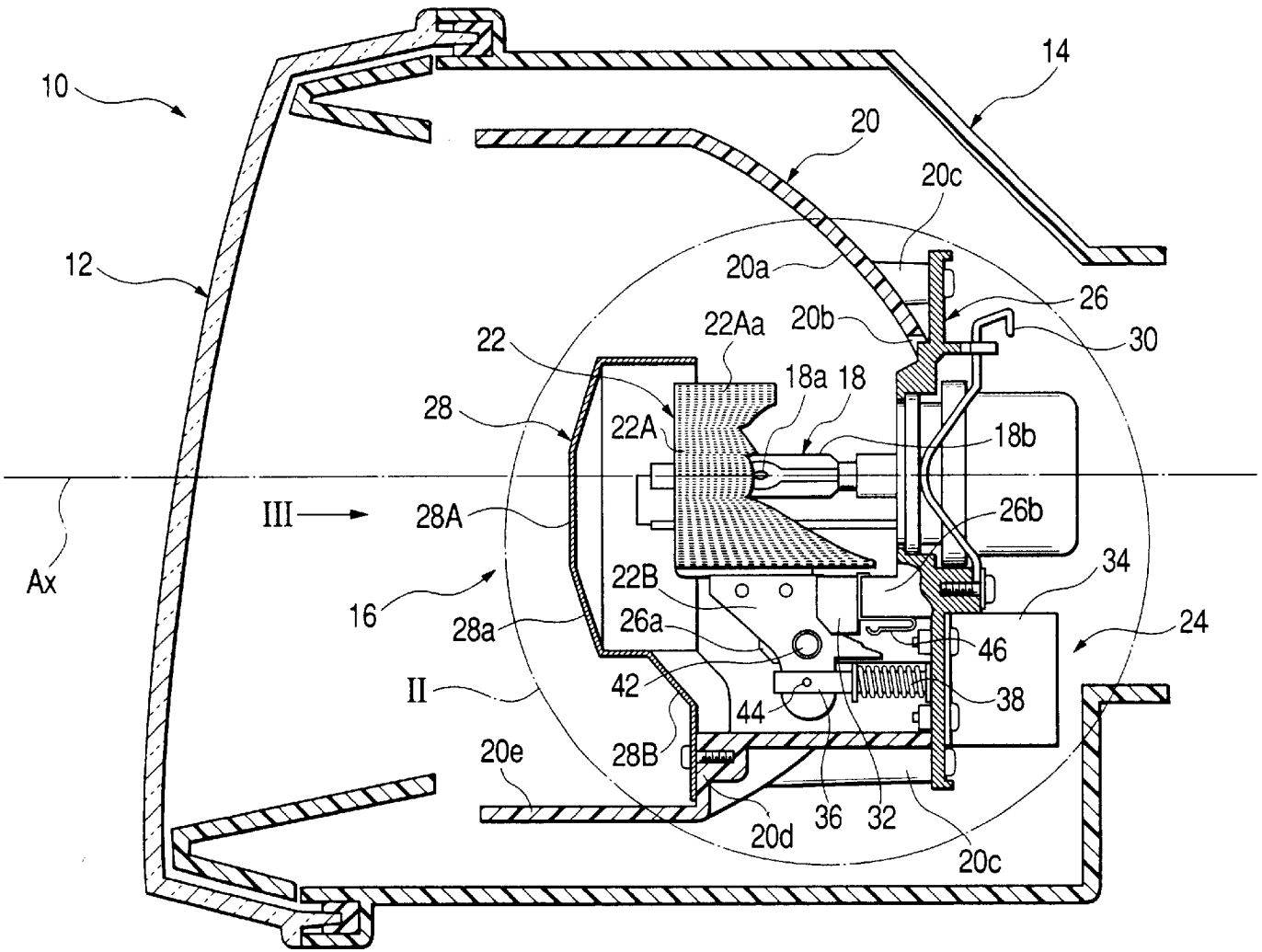
FIG. 1 is a sectional side view of a vehicle headlamp according to an embodiment of the invention.
Figure 2B:
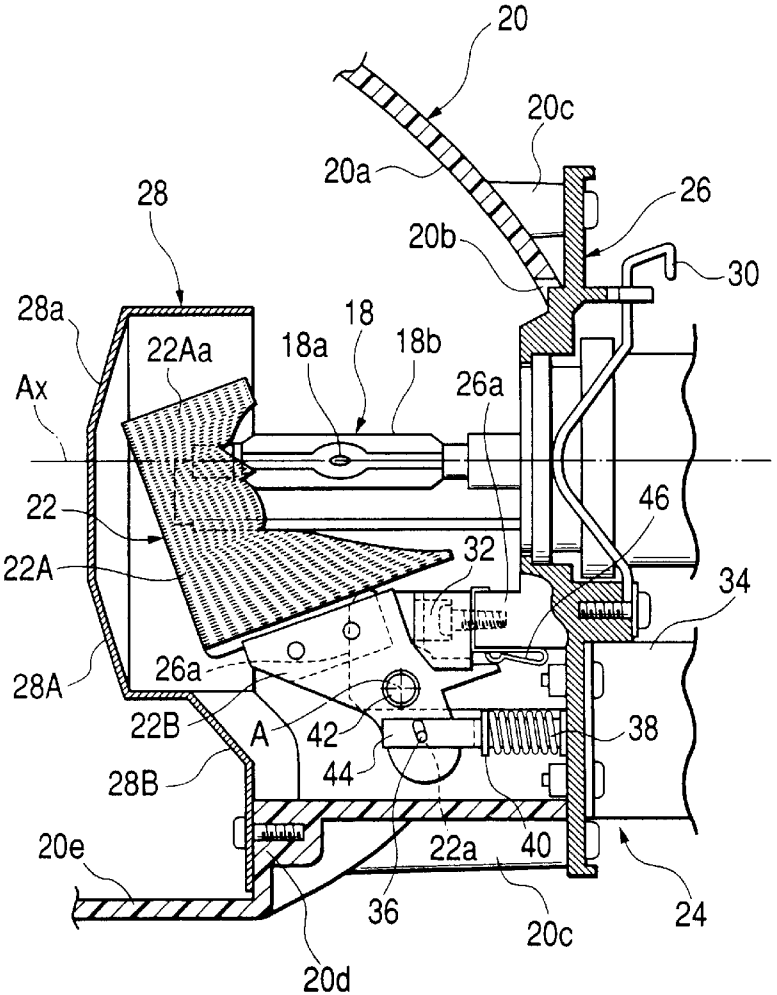
FIG. 2 is a detailed view of II region in FIG. 1.
Figure 2A:
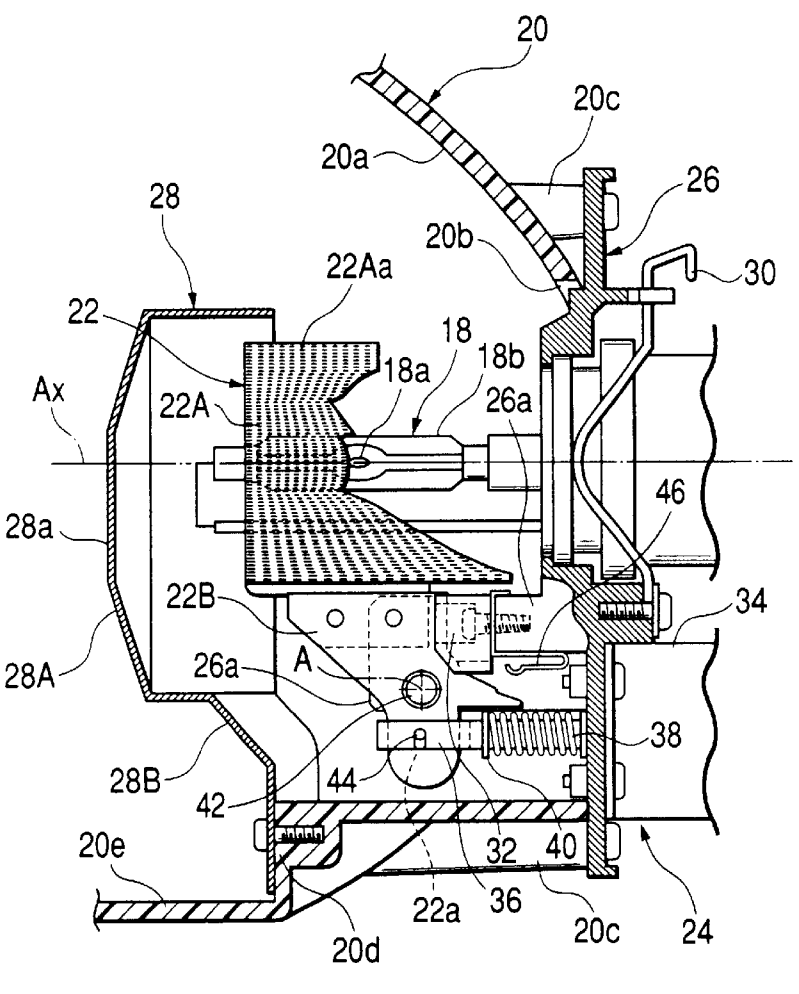
Figure 3:
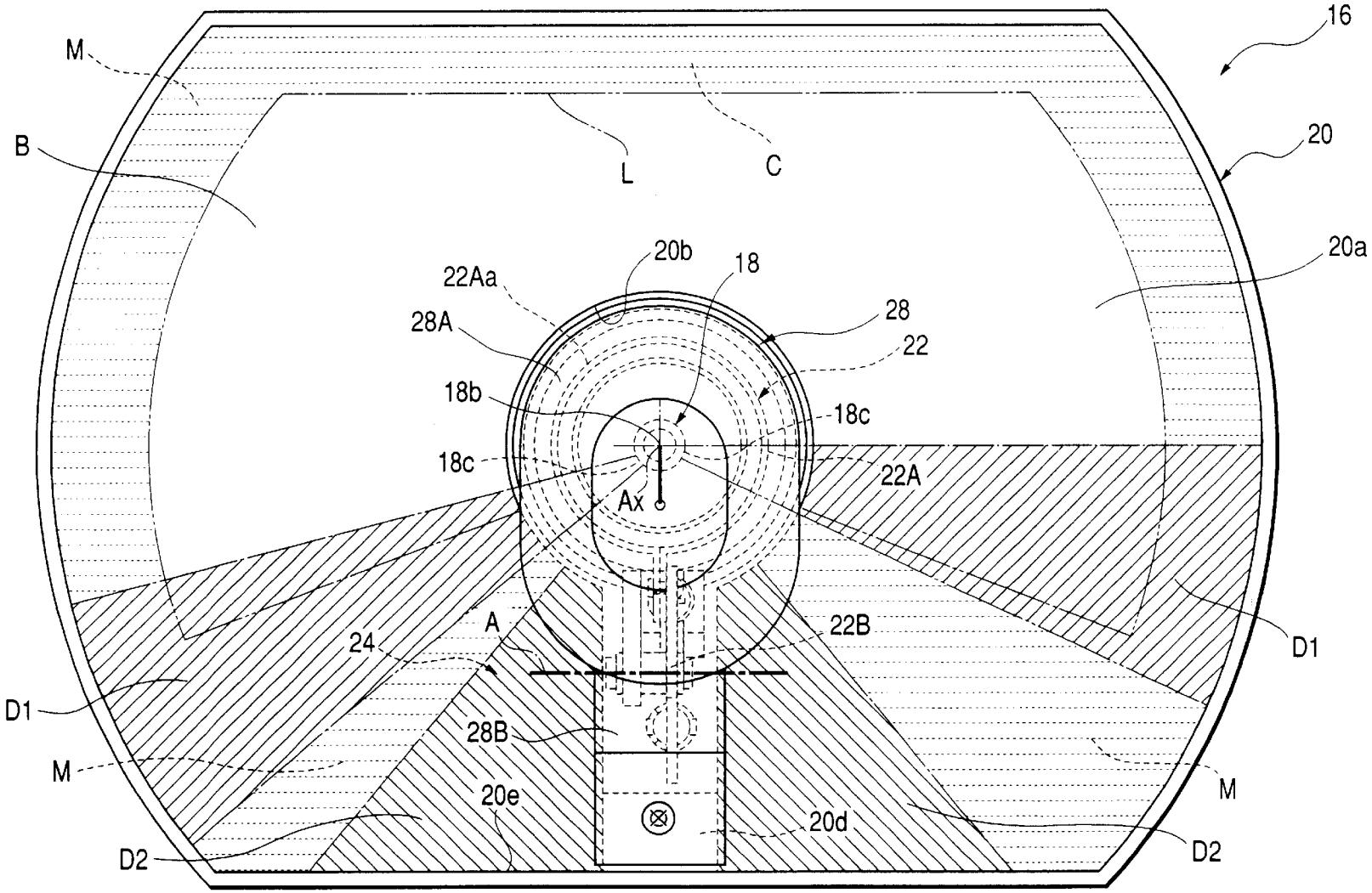
FIG. 3 is a sectional view taken on line III of FIG. 1.
Figure 4:
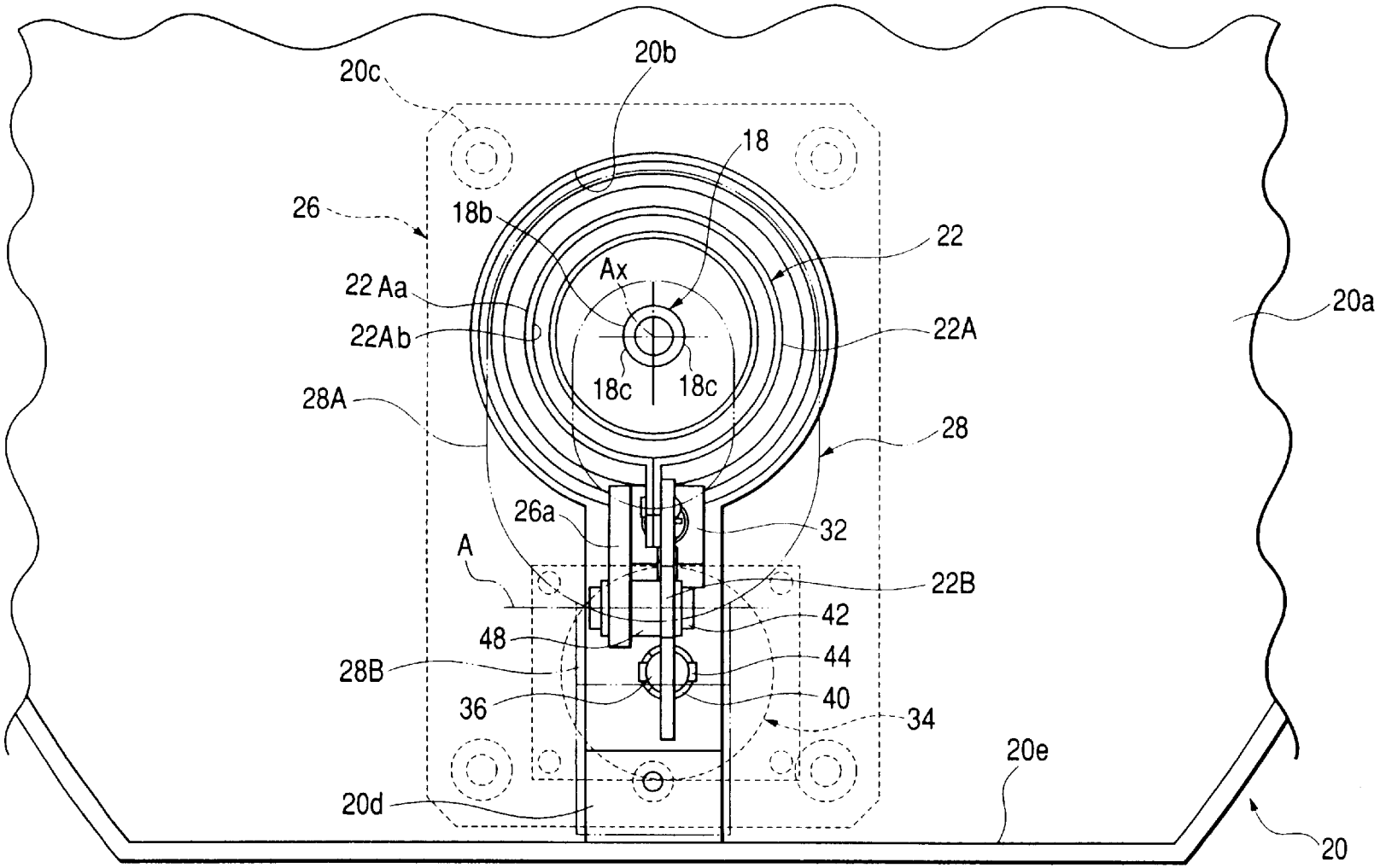
FIG. 4 is a detailed view of the principal part of FIG. 3.

FIG. 1 is a sectional side view of a vehicle headlamp according to an embodiment of the invention. FIG. 2 is a detail view of the II portion of FIG. 1. FIG. 3 is a detail view taken on line III of FIG. 1. FIG. 4 is a detail view of the principal part of FIG. 3.

As shown in FIG. 1, a vehicle headlamp 10 according to this embodiment of the invention is such that a reflector unit 16 is set tiltable vertically and horizontally via an aiming mechanism within a lamp chamber formed with a lens 12 and the lamp body 14.

The reflector unit 16 is provided with a discharge bulb (metal halide bulb) 18, a reflector 20, a movable shade 22, a shade driving unit 24, a bulb supporting base 26, and a fixed shade 28.

The lens 12 is a plain-glass lens and a light distribution control function is given to the reflector unit 16. More specifically, the reflector 20 has a reflective surface 20*a* for reflecting light forward from the discharge light emitting portion 18*a* (light source) of the discharge bulb 18 in order to emit beams for use in forming a predetermined light distribution pattern with the diffusion or deflection reflective function of the reflective surface 20*a*.

The discharge bulb 18 is fixedly supported by the reflector 20 via a bulb supporting base 26. In other words, the bulb supporting base 26 is made of aluminum alloy by die casting and fixed to a plurality of bosses 20*c* with screws on the back of the reflector 20 in such a state that the bulb supporting base 26 is inserted into the opening portion 20*b* in the rear top of the reflector 20 from the back. The discharge bulb 18 is fixedly supported with the bulb supporting base 26 by a wire spring 30. At this time, the discharge light emitting portion 18*a* of the discharge bulb 18 is positioned on the optical axis Ax of the reflector 20.

The movable shade 22 is formed with a cylindrical shade body 22A whose rear end edge has a complicated rugged shape, and a plate-like stay 22B extending from the lower end portion of the shade body 22A downward and slightly rearward, these shade body and the stay being riveted. The shade body 22A is made of a steel plate having an outer surface 22A*a* being coated with blue paint and an inner surface 22A*b* being coated with black paint. On the other hand, the stay 22B is formed of a stainless steel plate without any surface treatment.

The movable shade 22 is allowed by the shade driving unit 24 to assume a low-beam position as shown in FIG. 2(*a*) and a high-beam position as shown in FIG. 2 (*b*). Further, the movable shade 22 uses the shade body 22A to shade part of the light incident on the reflective surface 20*a* of the reflector 20 from the discharge light emitting portion 18*a* of the discharge bulb 18 in the low-beam position to produce the light necessary for emitting a low beam incident on the reflective surface 20*a*. In the high-beam position, the movable shade 22 operates to secure a quantity of light necessary for high-beam irradiation by reducing the shading quantity of the light incident on the reflective surface 20*a* because of the shade body 22A.

The shade driving unit 24 includes a solenoid 34 fixedly screwed to the bulb supporting base 26 under the optical axis Ax of the reflector 20, and a return spring 38 fitted to a movable iron core 36 of the solenoid 34 and used to urge the movable iron core 36 toward a n unexcited position.

The movable iron core 36 is equipped with an E-ring 40 in its intermediate portion for stopping the elastic urging force of the return spring 38 by abutting against the front end portion of the return spring 38, its front end portion being laterally forked.

The movable shade 22 is pivotally supported around a pivotal axis A laterally extending via a shaft member 42 formed in such a way as to protrude forward from the bulb supporting base 26 in the intermediate portion of its stay 22B. In this case, an annular spacer 48 is installed between the stay 22B and a support bracket 26*a*, so that the looseness of the coupling portion between the stay 22B and the shaft member 42 is minimized.

The movable shade 22 is coupled to the front end portion of the movable iron core 36 via a pin 44 in the lower end portion of the stay 22B in such a way that while the front end portion of the stay 22B is laterally clamped with the forked front end portion of the movable iron core 36, the movable shade 22 is fixed to the front end portion by laterally passing the pin 44 therethrough. A slit 22*a* for receiving the pin 44 is formed in the front end portion of the stay 22B so as to extend vertically. Thus, the variation in the distance between the shaft member 42 and the pin 44 is absorbed as the movable shade 22 pivots.

A projected portion 26*b* projecting forward is formed in a region close to the base portion of the support bracket 26*a* on the bulb supporting base 26. A displacement regulating block 32 is fixed from the front via a displacement regulating spring 46 to the projected portion 26*b* with a screw. The displacement regulating block 32 is made of a plastic resin member (e.g., fluororesin) that hardly produces any knocking sound, and a V-shaped groove is formed from its front end edge over the lower edge face.

The high beam is switched by the shade driving unit 24 to the low beam as follows:

When the beam changeover switch (not shown) of the shade driving unit 24 is turned off, as the movable iron core 36 of the solenoid 34 is released from being excited and displaced forward because of the elastic urging force of the return spring 38. Thus, the stay 22B of the movable shade 22 is pivoted backward around the pivotal axis A, and the stay 22B of the movable shade 22 butts against the front edge face of the displacement regulating block 32, so that the movable shade 22 is fixedly set in the low-beam position as shown in FIG. 2(*a*). However, the movable iron core 36 is moved back when the beam changeover switch is turned on to cause the movable iron core 36 of the solenoid 34 to be excited. Thus, the stay 22B of the movable shade 22 is pivoted forward around the pivotal axis up to a position where the stay 22B of the movable shade 22 butts against the lower edge face of the displacement regulating block 32 and fixed to the high-beam position shown in FIG. 2(*b*).

When the movable shade 22 is pivoted to the low- or high-beam position, the edge face 22*b* of its stay 22B butts against the base of the V-shaped groove. However, because the lateral displacement of the stay 22B is regulated by both side wall surfaces of the V-shaped groove, the deviation of the movable shade 22 in the longitudinal or lateral direction is prevented thereby. Further, the displacement regulating spring 46 fitted to the front end portion of the projected portion 26*b* of the bulb supporting base 26 is so formed as to extend substantially in U-shape along the underside of the projected portion 26*b*. When the movable shade 22 is pivoted to the high-beam position, it is subjected to elastic deformation by butting against the edge face 22*b* of the stay 22B. Thus, the useless knocking sound is prevented from being produced when the beams are switched. Thus, the backlash of the coupling portion between the stay 22B and the shaft member 42, that of the coupling portion between the stay 22B and the movable iron core 36 of the solenoid 34 and that of movable iron core 36 itself can be absorbed.

The fixed shade 28 for covering the movable shade 22 is provided substantially in front of the movable shade 22. The fixed shade 28 is formed integrally with a cap-like shade body 28A in the form of a vertically-long ellipse, and a sectionally U-shaped stay 28B extending from the lower end portion of the shade body 28A downward close to the rear side. Further, the fixed shade 28 is fixed to the reflector 20 with the screw in the lower end portion of the stay 28B. A shade fixing seat portion 20*d* is projected from the lower end portion of the reflective surface 20*a* in the reflector 20.

As shown in FIGS. 3 and 4, a pair of black stripes (light shading films) 18*c* extending like a belt in the optical axis Ax on the outer peripheral face of the shroud tube 18*b* of the discharge bulb is formed. Each of the black stripes 18*c* is set to have a peripheral width of 25°, and the central angle between the upper end edges of both the black stripes 18*c* is also set at 195°. Thus, the discharge bulb 18 is fitted to the reflector 20 so that one of the upper end edges of both the black stripes 18*c* is positioned on the horizontal plane passing the optical axis Ax.

As shown in FIG. 3, an area D1 shown by solid slanting lines toward the upper right in the reflective surface 20*a* of the reflector 20 is an area (inactive area) where no light is incident from the discharge light emitting portion 18*a* as it is in the shade of both of the black stripes 18*c* even though the discharge light emitting portion 18 is lighted. Even on the reflective surface 20*a*, no light is incident from the discharge light emitting portion 18 because of the shade body 22A when the movable shade 22 is located in the low-beam position in the area M shown by dotted horizontal lines. However, light is incident thereon (a special high beam area) from the discharge light emitting portion 18*a* without being interfered by the shade body 22A while the movable shade 22 stays in the high-beam position. In an area D2 shown by solid slant lines toward the upper left on the reflective surface 20*a*, no light is incident thereon from the discharge light emitting portion 18*a* (inactive area) as it is behind the shade body 22A even though the movable shade 22 is in the low-beam position. On an area B (common area) without slant lines on the reflective surface 20*a*, the light from the discharge light emitting portion 18*a* is incident even when the movable shade 22 is in the low- or high-beam position.

Figure 5:
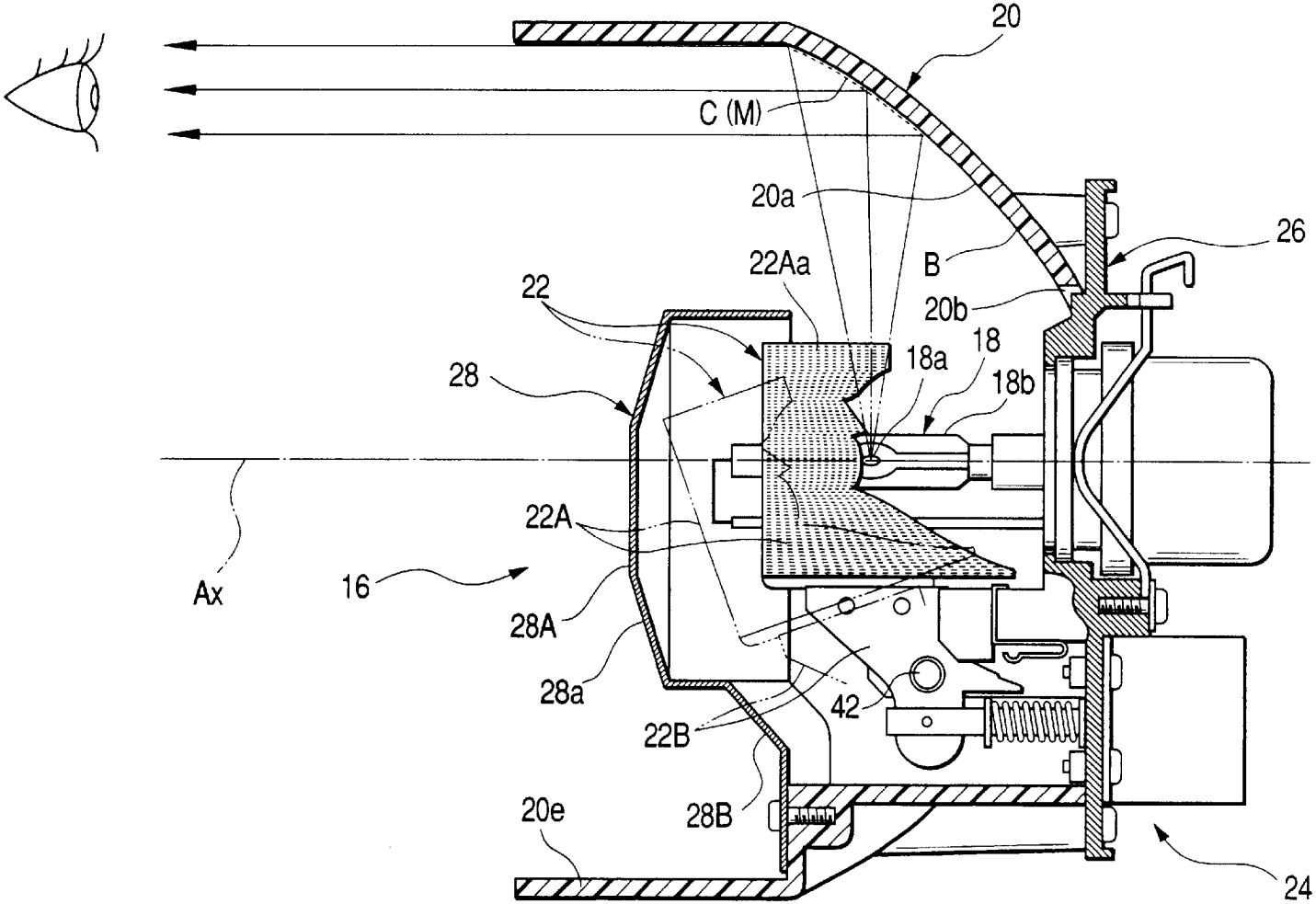
FIG. 5 is a sectional side view of the reflector unit of the vehicle headlamp as a single unit according to an embodiment of the invention.

FIG. 5 is a sectional side view of a single reflector unit 16.

While the movable shade 22 is in the low-beam position as shown in FIG. 5, when the headlamp is viewed from the front in the direction of the optical axis Ax, a portion close to the rear end portion of the outer surface 22A of the shade body 22A is reflected on the peripheral area (hereinafter called the "reflective area") C of the reflective surface 20*a* of the reflector 20.

The above reflective area C is an area that is outside the borderline L shown by a chain double-dashed line in FIG. 3 and formed with part of the special high beam area together with the inactive area D1. As the outer surface 22A*a* of the shade body 22A is coated in blue, the color of the outer surface 22A*a* is reflected on this reflective area C, which appears to be blue.

However, the shape of the reflective area C shown in FIG. 3 is viewed in the direction of observation of the lamp shown in FIG. 5 in front of the optical axis Ax. Shifting the direction of observation of the lamp vertically and horizontally therefrom causes the shape of the reflective area C to change in shape.

On the other hand, the inner surface 22A of the shade body 22A as well as the shroud tube 18*b* of the discharge bulb appear to be reflected on the area inside the boundary line L on the reflective surface 20*a* of the reflector 20 when the lamp is viewed from the front in the direction of the optical axis Ax. Since the inner surface 22A*a* of the s ha de body 22A is treated with the black coating, the area inside the boundary line L appears black. However, even the area inside the boundary line L appears deformed by shifting vertically and horizontally the direction of observation of the lamp from the forward direction of the optical axis Ax as shown in FIG. 5, and the lower wall surface 20*e* of the reflector 20 and the like may be reflected on the reflective surface 20*a* depending on the observation angle.

As shown in FIG. 5, because the shade body 22A has been displaced forward while the movable shade 22 is in the high-beam position, the outer surface 22A*a* of the shade body 22A only appears to be only slightly reflected on the reflective surface 20*a* of the reflector 20 when it is viewed from the front of the lamp. More specifically, the outer surface 22A*a* of the shade body 22A is made to reflect only on the inactive area D1 of the reflective surface 20*a* of the reflector 20.

As set forth above in detail, the vehicle headlamp 10 according to an embodiment of the invention is equipped with the shade driving unit 24 for pivoting the movable shade 22 between at least two positions where the incident light is shaded in different degrees, the movable shade 22 being capable of shading part of the light incident on the reflective surface 20*a* of the reflector 20 from the discharge light emitting portion 18*a* of the discharge bulb 18. Since the shade body portion 22A surrounding the discharge bulb 18 in the movable shade 22 has the blue outer surface 22A*a*, the following effect can be achieved.

When the lamp is viewed from the front, the surface color of the shade body portion 22A (e.g., blue of the outer surface 22A*a* or black of the inner surface 22A*b*) or the transparent color of the shroud tube 18*b* of the discharge bulb 18 or the silver color of the lower wall surface 20*e* of the reflector 20 generally appears to be reflected on the reflective surface 20*a* of the reflector. According to this embodiment of the invention, however, the blue color of the outer surface 22A*a* of the shade body portion 22A appears to be reflected on the large area of the reflective surface 20*a* of the reflector 20. The blue reflective area C is extremely conspicuous because any other area appears to be colored silver or achromatic. Moreover, the reflective area C greatly changes in shape as the movable shade 22 moves to the high-beam position. That is, even the size of the inactive area D1 is made smaller. Therefore, it is possible to visually confirm changes easily in the light distribution of the lamp from the front by moving the movable shade 22. Thus, the design of the lamp can also be improved.

Particularly, according to this embodiment of the invention, since the movable shade 22 is fixed to the low-beam position while the lamp is not turned on, the blue color of the outer surface 22A*a* of the shade body portion 22A is reflected on the wide area of the reflector 20. Consequently, part of the reflector 20 appears blue when the lamp in the off condition is viewed from the front. Thus, the design of the lamp can be improved.

Moreover, because the outer surface 22A*a* of the shade body portion 22A is blue in color, the following effect can be achieved. Since the vehicle headlamp 10 according to this embodiment of the invention is equipped with the discharge bulb 18, the lamp itself appears pallid blue because beams are emitted at high color temperatures when the lamp is turned on. Since the outer surface 22A*a* of the shade body portion 22A is colored blue, however, the interior of the lamp appears to be blue even when the lamp is not turned on. Thus, any observer of the lamp will be left with an impression that the lamp is of a high-grade type having a discharge bulb.

Further, according to this embodiment of the invention, as the movable shade 22 is moved by the shade driving unit 24 in a manner that displaces the shade body portion substantially longitudinally, the blue area reflected on the reflector 20 greatly varies as the movable shade 22 moves. When the movable shade 22 has moved to the high-beam position, the outer surface 22A*a* of the shade body portion 22A is only slightly reflected on the reflective surface 20*a* of the reflector 20 when the lamp is viewed from the front. Therefore, switching beams can be visually confirmed easily from the front of the lamp. Thus, the design of the lamp can be improved.

According to the embodiment of the invention, further, the fixed shade 28 for covering the movable shade 22 substantially in front of the movable shade 22 makes it difficult for the movable shade 22 and its peripheral structure (i.e., the structure of supporting the bulb supporting base 26 of the movable shade 22 and coupling the movable shade 22 and the movable iron core 36 of the solenoid 34) to be seen from the outside.

When the outer surface 22A*a* of the shade body portion 22A is blue, the light reflected from the reflector 20 is reflected from the outer surface 22A*a* thereof so as to generate stray light easily in comparison with a case where the chromatic color is black. However, the fixed shade 28 close to the front of the movable shade 22 results in effectively preventing the generation of such stray light.

According to the embodiment of the invention, since the fixed shade 28 has the outer surface 22A*a* having the same silver color as that of the reflective surface 20*a* of the reflector 20, the blue color of the outer surface 22A*a* of the shade body portion 22A reflected on the reflective surface 20*a* of the reflector 20 can be made conspicuous further.

Although the color of the outer surface 22A*a* of the shade body portion 22A is blue according to this embodiment of the invention, any other color (e.g., green, yellow or the same color of a vehicle) may be used. The color of the outer surface 28*a* of the fixed shade 28 may be set to a particular chromatic color for coordinating purposes.

The present invention claims priority from Japanese patent application Ser. No. H11-296080, which is incorporated herein by this reference in its entirety.

Several embodiments of the invention have been described herein, but it should be understood that various additions and modifications could be made which fall within the scope of the following claims.

What is claimed is:

1. A vehicle headlamp comprising a light source;

a reflector for reflecting light from said light source forward;

a movable shade capable of shading part of light incident on said reflector from the light source; and a shade driving unit for moving the movable shade between two positions where an incident light is shaded in different degrees, wherein said movable shade has a shade body portion of which outer surface has a color, said body portion surrounding at least part of said light source, wherein a fixed shade for covering at least part of said movable shade is provided substantially in front of said movable shade.

2. The vehicle headlamp as claimed in claim 1, the movement of said movable shade by said shade driving unit is made in a manner that displaces said shade body portion substantially longitudinally.

3. The vehicle headlamp as claimed in claim 2, wherein a fixed shade for covering at least part of said movable shade is provided substantially in front of said movable shade.

4. The vehicle headlamp as claimed in claim 1 wherein the shade body portion is made of a material of the color.

5. The vehicle headlamp as claimed in claim 1 wherein the shade body portion has its outer surface treated with the color.

6. The vehicle headlamp as claimed in claim 1 wherein the color of the shade body portion is a metallic color.

7. The vehicle headlamp as claimed in claim 1 wherein the color of the shade body portion is blue.

8. The vehicle headlamp as claimed in claim 1 wherein a color of the fixed shade is the same color as that of a vehicle body.

9. The vehicle headlamp as claimed in claim 1 wherein a color of the fixed shade is the same color as that of the shade body portion.

10. The vehicle headlamp as claimed in claim 1 wherein said reflector has a reflective area where said color of the shade portion is reflected thereto at one of said at least two positions of which incident light being respectively shaded has the degree of not less than others.

11. The vehicle headlamp as claimed in claim 10 wherein an area of said reflective area varies in accordance with said at least two positions.

12. The vehicle headlamp as claimed in claim 10 wherein said movable shade is formed in a semi-cylindrical shape and said reflective area is arranged in a vicinity of an open end portion of the reflector.

13. The vehicle headlamp as claimed in claim 11 wherein said movable shade is formed in a semi-cylindrical shape and said reflective area is arranged in a vicinity of an open end portion of the reflector.

* * * * *